United States Patent [19]

Kimura et al.

[11] Patent Number: 4,668,939

[45] Date of Patent: May 26, 1987

[54] APPARATUS FOR MONITORING DISTURBANCES IN-ENVIRONMENTAL CONDITIONS

[75] Inventors: Tetsuo Kimura, Hachioji; Seiichi Tanaka, Chiba, both of Japan

[73] Assignee: Nittan Company, Limited, Tokyo, Japan

[21] Appl. No.: 854,160

[22] Filed: Apr. 21, 1986

Related U.S. Application Data

[63] Continuation-in-part of Ser. No. 523,124, Aug. 15, 1983, abandoned.

[30] Foreign Application Priority Data

Aug. 27, 1982 [JP] Japan ..... 57-147574

[51] Int. Cl.[4] ..... G08B 19/00; G08B 26/00

[52] U.S. Cl. ..... 340/521; 340/505; 340/511; 340/518; 340/525; 340/825.1; 340/825.54

[58] Field of Search ..... 340/521, 518, 517, 506, 340/505, 511, 514, 524, 525, 660, 661, 825.06–825.13, 825.54, 825.55

[56] References Cited

U.S. PATENT DOCUMENTS

| | | | |
|---|---|---|---|
| 3,665,399 | 5/1972 | Zehr et al. | 340/518 |
| 3,676,878 | 7/1972 | Linder | 340/518 |
| 4,001,785 | 1/1977 | Miyazaki et al. | 340/518 |
| 4,067,008 | 1/1978 | Sprowls, III | 340/518 |

*Primary Examiner*—Donnie L. Crosland
*Attorney, Agent, or Firm*—Abelman Frayne Rezac & Schwab

[57] ABSTRACT

An improved apparatus for detecting environmental disturbances such as the occurrence of a fire, a gas leak or the like, includes a central processing unit and a plurality of terminal detectors, wherein an identification code is assigned to each of the detectors and the central processing unit sequentially calls the detectors in rotation requesting them to transmit thereto the data collected on smoke concentration, gas concentration, temperature or the like. The apparatus is provided with a display unit and a memory. Data collected by each detector concerning on the environmental condition of the place where each detector is installed are stored in the memory in time series. When a signal for data exceeding a fixed reference level is received, a provisional alarm is raised for the operator and the stored data for a limited period of time in the past are displayed. The operator, upon noticing the alarm, reads the displayed data and judges whether a disturbance, a fire for instance, has occurred basing his judgment on his interpretation of the pattern of the past data in the light of the specific characteristics of said detector and the place where the detector is installed, and, when he judges that a disturbance has occurred, he manually issues a general alarm.

6 Claims, 2 Drawing Figures

APPARATUS FOR MONITORING DISTURBANCES IN ENVIRONMENTAL CONDITIONS

CROSS REFERENCE TO RELATED PATENT APPLICATION

This is a continuation-in-part patent application of patent application Ser. No. 523,124 filed August 15, 1983 now abandoned.

TECHNICAL FIELD OF THE INVENTION

This invention relates to an apparatus for monitoring the environment for disturbances such as the occurrence of a fire, a gas leak and the like. More particularly, the invention relates to an apparatus which comprises a central operation unit and a plurality of terminal detectors connected thereto, wherein an identification code is assigned to each of the detectors and the central operation unit sequentially calls the detectors in rotation by the identification codes requesting them to transmit data on the detected smoke concentration, gas concentration, temperature and the like.

BACKGROUND OF THE INVENTION

Prior art monitoring apparatuses of the type mentioned above simply judge the occurrence of a disturbance by mechanical comparison of the detected data with a single fixed reference level and automatically issue an alarm. However, the environmental conditions of the places where the detectors are installed differ from place to place. Also the characteristics of the detectors may vary from detector to detector because of minute difference in the product quality and aging. Therefore, prior art monitoring apparatuses as mentioned above often issue false alarms or fail to issue alarms when required.

It is possible to use more complicated variables as the indication of disturbances. For instance, there are apparatuses in which amount of change in a fixed period of time is measured and compared with a reference. It is possible to employ a more complicated reference instead of a fixed level. For instance, the average or integral of data collected over a fixed period of time preceding the judgment can be employed as a reference. However judgment based on a complicated variable or a complicated reference will require a complicated algorithm which means that an expensive processing unit is required. It is not practical to provide such an expensive processing unit for each detector. Therefore, judgment is usually made by a single processing unit provided with a single reference for all the detectors. That is, it is impossible to take into consideration the individual characteristics of each sensor such as the time course change in sensitivity and the conditions of the place where the detector is installed.

Therefore, it is the object of this invention to overcome the above-stated drawback of prior art apparatuses. That is, the object of this invention is to provide an apparatus for monitoring environmental disturbances which enables the operator to determine the occurrence of a disturbance taking into consideration the individual characteristics of each detector and the conditions of the place where each detector is installed.

DISCLOSURE OF THE INVENTION

According to this invention, there is provided, in an apparatus for detecting environmental disturbances such as the occurrence of a fire, a gas leak or the like comprising a central processing unit and a plurality of terminal detectors, wherein an identification code is assigned to each of the detectors and the central processing unit sequentially calls the detectors in rotation requesting them to transmit thereto the data collected on a specific environmental condition such as smoke concentration, gas concentration, temperature or the like, the improved apparatus provided with a memory connected to the central processing unit in which memory data on the detected condition which have been transmitted from the detectors over a limited period of time can be stored for each detector, and a display unit which can display the data for the limited period stored in the memory, whereby the central processing unit compares the fresh data transmitted from each detector with a single fixed reference level and causes the display unit to display the data which have been transmitted from said detector and have been stored in the memory in a past limited period of time when said fresh data exceeds the reference level.

In the apparatus of this invention, the detector usually comprises a terminal unit, a sensor which can sense a specific environmental condition and outputs a signal corresponding to the level of the sensed condition, and an A/D converter, which may belong to either the terminal unit or the sensor. The terminal unit is an ordinary polling terminal unit. The sensor may be a smoke sensor, a gas sensor, a heat sensor or the like. Sensors usually output analog signals corresponding to detected conditions, and these signals are usually digitized before they are sent out on the transmission line.

The CPU is accompanied by interfaces for connection with the terminal detectors and peripheral equipment such as a display unit, a console, etc. and forms a central operation unit. Usually a transmission control circuit is inserted between the terminal detectors and an interface for the CPU in order to transform signals from the logical form to the transmission form and vice versa.

The data for the limited period in the past stored in the memory is displayed in the form of a pattern or a graphical presentation of a series of values on the display unit, which the operator can read.

The apparatus of this invention leaves the final decision as to whether an alarm must be issued or not to the operator's interpretation of the data accumulated during the preceding limited period for each detector. These data are presented as a pattern on the display unit, and his judgment is based thereon. In comparison with prior art apparatuses of this kind which automatically issue an alarm upon mechanical comparison of the piece of data on a detected condition and a single fixed reference, false alarming and failure in alarming are well avoided when this apparatus is used with the help of an experienced operator. The apparatus of this invention is more a simplified monitoring system than an alarm apparatus. Of course, the apparatus can be constructed so that a general alarm is automatically generated when the signal or fresh data exceeds a fixed reference value. In this case, the comparison with the stored data of the preceding period of time will serve for revision of the fixed reference.

The apparatus of this invention can easily be specifically designed and constructed by those who are skilled in the art upon reading the following detailed description of the invention.

BRIEF DESCRIPTION OF THE ATTACHED DRAWING

DETAILED DESCRIPTION OF EMBODIMENT OF THE INVENTION

Figure 1:
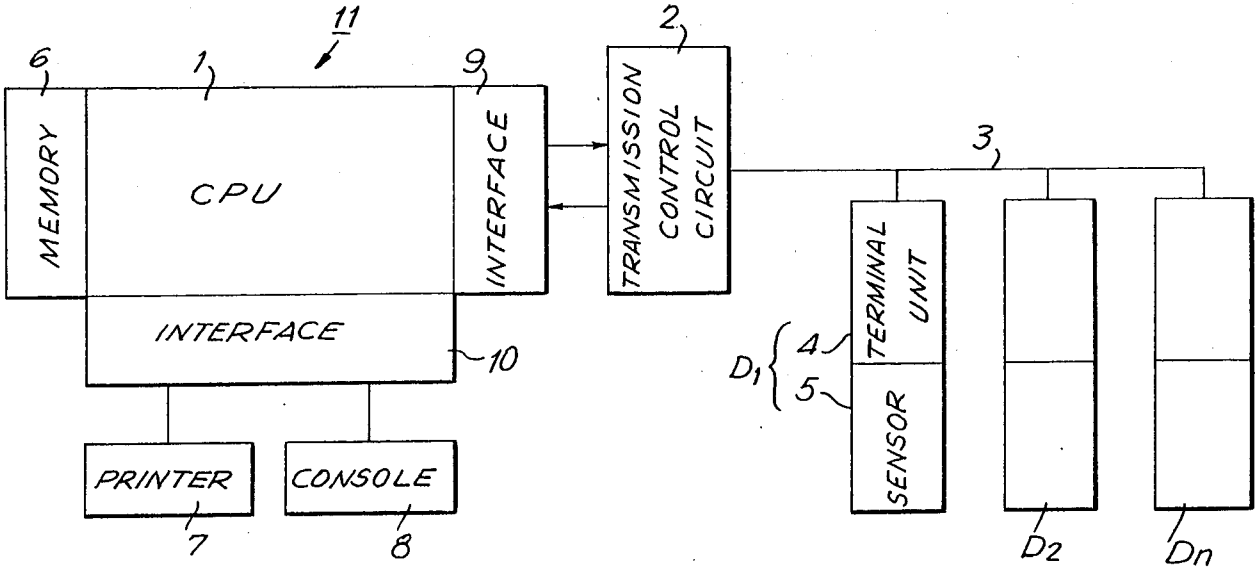
FIG. 1 is a block diagram showing the concept of an embodiment of the apparatus of this invention.

The apparatus of the embodiment as shown in FIG. 1 comprises central operation unit 11, a transmission control circuit 2 connected to the CPU 1, a transmission line 3 connected to the transmission control circuit 2, and a plurality of detectors $D_1$, $D_2$, $D_3 \ldots D_n$ connected to the transmission line 3. Each detector comprises a sensor 5 and a terminal unit 4 and usually includes an A/D converter not specifically shown. An identification code is assigned to each detector.

The central operation unit 11 comprises a commercially available standard microprocessor or CPU (INTEL 8085 for instance) 1, a commercially available RAM (INTEL 2114 for instance) 6, an interface 9 and another interface 10. The interface 9 comprises a latch circuit, a buffer, etc. and these are used to compensate difference in treating speed when data are exchanged between the CPU and the peripherals. A suitable one is INTEL 8255 for instance. The interface 10 functions in the same way and INTEL 8279 and 8255 were used.

Figure 2:
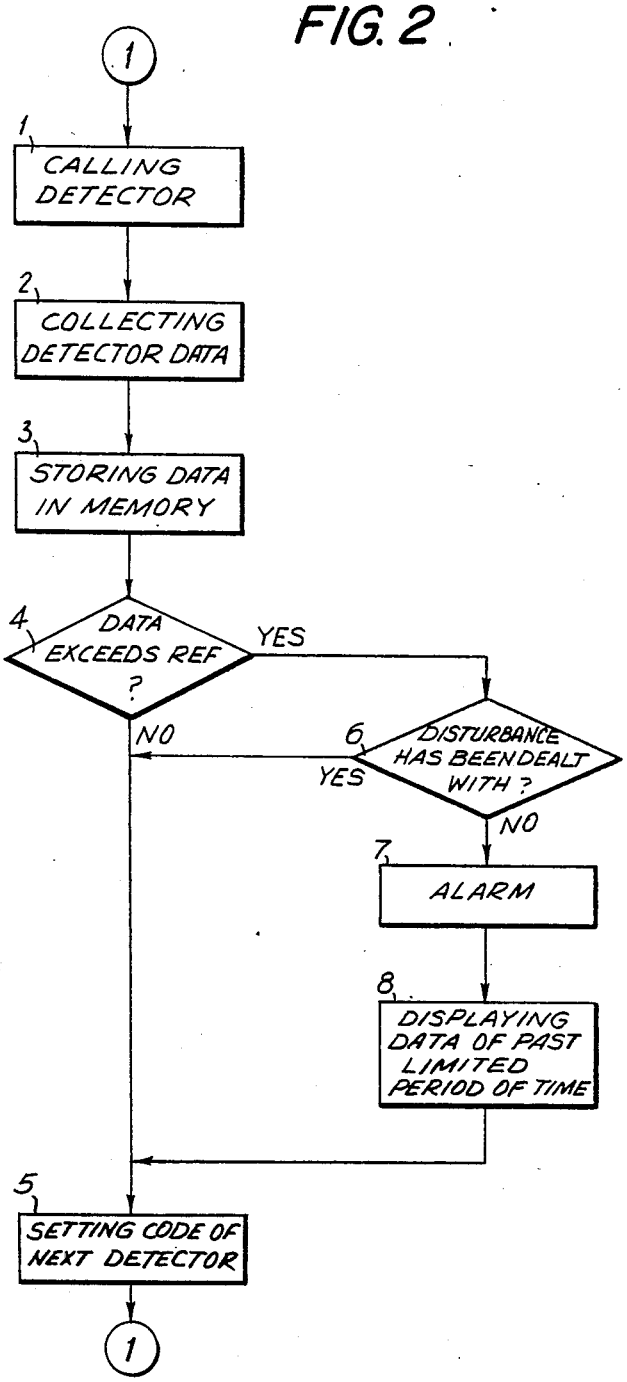
FIG. 2 is a flow chart representing the operation of the CPU.

The central operation unit 11 is constructed so that it is operable in accordance with the flow chart in FIG. 2. That is, in Step 1, a particular detector is called, and in Step 2, data such as smoke concentration is taken in. In Step 3, the data is stored in the memory. In Step 4, the data is compared with the reference, and if the data does not exceed the reference, operation proceeds to Step 5, where the next detector identification code is set, and Steps 1–5 are repeated. If the data exceeds the reference at Step 4, the operation proceeds to Step 6, where it is checked whether the alarming and display as mentioned below were completed or not. If it was completed, a new detector code is automatically set and operation returned to Step 1. If it was not completed, the alarm for an operator is generated at Step 7, and the data for the past limited period time is displayed for monitoring, and thus the general alarm is generated or not. After that, the operation returns to Step 5. Step 6 is required so that when a detector the data of which exceeded the reference is polled next time, alarming and display are not repeated even if the disturbance condition continues. The display is preferably made by plotting on a chart sheet points representing pieces of data of the past limited period of time. By the shape of a curve formed by the plotted points, the condition of occurrence of disturbance can be judged. Thus the CPU sequentially calls the detectors $D_1$, $D_2$, $D_3 \ldots D_n$ in rotation by the identification code in a predetermined order. More particularly, the CPU 1 first designates the identification code of the detector $D_1$ for instance, then the identification code is transformed into a suitable signal form in the interface 9 and the transmission control circuit 2 and sent out on the transmission line 3.

Each detector constantly monitors the signals being sent out on the transmission line 3, and when the detector $D_1$ receives a signal representing its identification code, it sends out a signal corresponding to the data on the environmental condition collected by its sensor. The sensor 5 may be a smoke sensor, a gas sensor, a heat sensor or the like as mentioned above, and produces an analog signal corresponding to the sensed environmental condition. The collected data on the environmental condition is preferably and usually digitized by an A/D converter provided in the detector before it is sent out, although this is not essential. The signal for the data transmitted through the transmission line 3 from the detector $D_1$ is input into the CPU 1 after it is transformed into a logical form by the transmission control circuit 2 and the interface 9. The data is written in the memory 6 at the location corresponding to said detector. This operation is repeated in rotation for the detectors $D_1$ through $D_n$.

As mentioned above, the polling is conducted sequentially in rotation for a plurality of detectors. Therefore, the signals from a detector are periodically received and stored in the corresponding location of the memory in succession for a period as long as the capacity of the memory allows. In this way, time series data are stored in each location for each detector. At the same time, every piece of data received is compared with a fixed reference level (value) in the CPU.

When a piece of data (signal) which exceeds the reference level is received, the CPU provisionally judges that a disturbance has occurred, and produces an alarm (usually a sound which may or may not be accompanied by visual indication) only for the operator. At the same time, the preceding data stored for the detector which transmitted the signal exceeding the reference level are read out through the interface 10 and displayed in a print-out sheet in a printer 7 connected to the interface as a pattern, a graphical presentation of a series of values. Instead of such a printer, a graphic display unit or a cathode ray tube may be used as a display unit. This display can be automatically made or made upon request by the operator.

Upon noticing the alarm, the operator can check the displayed data pattern for said detector for the preceding limited period of time, and judge whether a disturbance, a fire for instance, has really occurred or not. The environments of the places where the detectors are placed differ from place to place, and the detectors will develop their own individual characteristics by aging, and therefore, the pattern of recorded data with respect to a detector has characteristics inherent thereto. An experienced operator can comprehensively interpret the pattern and judge whether or not a fire, etc. has occurred, and if he judges that one has occurred, he can manually generate a general alarm.

Again with reference to FIG. 2, when a detector with which a disturbance is recognized is called again, operation proceeds to Step 5 to call the next detector, and the detector with which the disturbance has been recognized is reset after alarming or any other necessary measure is taken. Even when disturbance occurs in more than 1 detector, the same measure can be taken.

The past data on the neighboring detectors can be read out and displayed by operation of a console 8 connected to the interface 10 allowing them to be checked for the purpose of comparison or reference if the operator so desires.

Receipt and storage of data (information) from the detectors are continued while the operator is judging whether the situation reported from a detector is a disturbance (fire) in comparison with the displayed pattern of the past data for said detector. Therefore, in addition to the past data on the same detector, the operator can make displayed the data from the detector in question after the provisional alarm has been raised. By doing so, the operator will be able to make a better judgment.

Further, the operator will be able to obtain information on the situation after a fire, for instance, has occurred, that is, development or extinguishment of the fire. The apparatus of this invention has a great advantage in that occurrence of a disturbance can be judged by an operator in consideration of the individual characteristics of each detector and the place where it is installed.

It is possible to set the above-mentioned reference level lower than the normal level for a disturbance so that the apparatus can issue a preliminary alarm. In this case, the operator can learn about a possible disturbance from an earlier stage thereof by reading out the past data as well as the data after the preliminary alarm has been issued. This will make it possible for the operator to notice a disturbance at an earlier stage.

The data stored in the memory are replaced with new data in turn from the earlier data, that is, the older data are successively erased as new data are taken in. The length of the period for which the data can be stored is limited by the capacity of the memory, the cost relating thereto, etc., although it is desirable that the period be as long as possible. A suitable length for the period is set within the limitation with consideration being given to the nature of the disturbance to be detected. For the purpose of fire detection for instance, a period of around 30 minutes will be suitable when smoldering fire is taken into consideration.

Instead of storing every piece of data transmitted back from each detector, the average or maximum of the several successive pieces of data in the past or pieces of data over a past limited period of time, several seconds for instance, can be stored. In this way, the relative capacity of a memory increases and thus a memory of a limited capacity can be used more efficiently.

We claim:

1. In an apparatus for detecting environmental disturbances such as the occurrence of a fire, a gas leak or the like comprising a central processing unit and a plurality of terminal detectors, wherein an identification code is assigned to each of the detectors and the central processing unit sequentially calls the detectors in rotation requesting them to transmit thereto the data collected on a specific environmental condition such as smoke concentration, gas concentration, temperature or the like, the improved apparatus provided with a memory connected to the central processing unit in which memory data on the detected condition which have been transmitted from the detectors over a limited period of time can be stored for each detector, and a display unit which can display the data for the limited period stored in the memory, whereby the central processing unit compares the fresh data transmitted from each detector with a single fixed reference level and causes the display unit to display the data which have been transmitted from said detector and have been stored in the memory in a past limited period of time when said fresh data exceeds the reference level.

2. An apparatus for detecting environmental disturbances as claimed in claim 1, which can display the data stored in a past limited period of time for the detectors other than the detector which transmitted the signal exceeding the reference level.

3. An apparatus for detecting environmental disturbances as claimed in claim 1, which can store and display the data which have been collected by a detector after said detector transmitted a signal exceeding the reference level.

4. An apparatus for detecting environmental disturbances as claimed in any one of claims 1 through 3, which can issue a provisional alarm when a signal exceeding the reference level is received by the CPU.

5. An apparatus for detecting environmental disturbances as claimed in any one of claims 1 through 3, which can set a reference level which is lower than the normal reference level for the disturbance to be detected.

6. An apparatus for detecting environmental disturbances as claimed in any one of claims 1 through 3, wherein the detector comprises a sensor selected from a smoke sensor, a gas sensor and heat sensor.

* * * * *